US009554673B2

(12) United States Patent
Panzella

(10) Patent No.: US 9,554,673 B2
(45) Date of Patent: Jan. 31, 2017

(54) SHOWER CADDY FOR HOLDING TOWEL AND OTHER ITEMS

(71) Applicant: Katharine C. Panzella, Powder Springs, GA (US)

(72) Inventor: Katharine C. Panzella, Powder Springs, GA (US)

( * ) Notice: Subject to any disclaimer, the term of this patent is extended or adjusted under 35 U.S.C. 154(b) by 685 days.

(21) Appl. No.: 13/920,229

(22) Filed: Jun. 18, 2013

(65) Prior Publication Data

US 2013/0341216 A1 Dec. 26, 2013

Related U.S. Application Data

(60) Provisional application No. 61/662,951, filed on Jun. 22, 2012.

(51) Int. Cl.

| | |
|---|---|
| ***A47K 3/00*** | (2006.01) |
| ***A47G 29/08*** | (2006.01) |
| ***A47B 96/00*** | (2006.01) |
| ***A47K 3/28*** | (2006.01) |
| ***A47K 17/00*** | (2006.01) |
| ***A47K 5/18*** | (2006.01) |

(52) U.S. Cl.

CPC ..... *A47K 3/281* (2013.01); *A47B 96/00* (2013.01); *A47G 29/08* (2013.01); *A47K 3/001* (2013.01); *A47K 5/18* (2013.01); *A47K 17/00* (2013.01)

(58) Field of Classification Search

CPC ..... A47K 5/18; A47K 3/001; A47K 3/281; A47G 29/08; A47B 47/00; A47B 96/00

See application file for complete search history.

(56) References Cited

U.S. PATENT DOCUMENTS

| | | | |
|---|---|---|---|
| 2,876,908 | A | 3/1959 | Mangum |
| 3,059,374 | A | 10/1962 | Bernay |
| 3,181,702 | A | 5/1965 | Raphael |
| 3,266,764 | A | 8/1966 | Briles |
| 3,789,996 | A | 2/1974 | Stroh |
| 3,923,162 | A | 12/1975 | Hussey |
| 4,387,811 | A | 6/1983 | Ragir et al. |
| 4,541,131 | A | 9/1985 | Sussman |
| 5,180,067 | A | 1/1993 | Conaway et al. |
| 5,620,105 | A | 4/1997 | Macek |
| 6,581,790 | B1 | 6/2003 | Zadro |
| 7,770,742 | B1 | 8/2010 | Wagner et al. |
| 8,051,506 | B2 | 11/2011 | Segal |

*Primary Examiner* — Michael Safavi

(74) *Attorney, Agent, or Firm* — J.T. Hollin, Attorney at Law, P.C.

(57) ABSTRACT

A towel shower caddy for an improved combination apparatus designed to safely, securely, and efficiently store and transport items, which may be used in the course of personal showering or bathing. The device is essentially comprised of at least one storage container that may contain a towel or other items, may attach above or below a shower head pipe, has a door which may contain a speaker and other electronic devices, a moveable exterior shelf, two detachable hanger members, four detachable suction cups, a support base, a detachable interior shelf and dividing wall, and a collapsible and detachable carrying handle. Different embodiments of the towel shower caddy may include a frame 10, a door 20, a fixed handle assembly 30, a support base system 40, a fixed hanger system 50, two hanger covers 60, and a detachable exterior shelf system 70.

21 Claims, 14 Drawing Sheets

SHOWER CADDY FOR HOLDING TOWEL AND OTHER ITEMS

CROSS-REFERENCES TO RELATED APPLICATIONS

This patent application claims the benefit of priority from previously-filed U.S. provisional patent application, Ser. No. 61/662,951, filed on Jun. 22, 2012, and claims the content of said provisional application as though fully appearing herein.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A "SEQUENCE LISTING," A TABLE, OR A COMPUTER PROGRAM

Not applicable.

BACKGROUND OF THE INVENTION

1. Field of the Invention

The present invention relates generally to accessory storage systems, and more specifically it relates to a towel shower caddy for an improved combination apparatus designed to safely, securely, and efficiently store and transport items. The device is primarily comprised of at least one storage container that may hold a towel and other items, may attach above or below a shower head pipe, has a waterproof door which may contain a speaker, a detachable exterior shelf, a detachable hanger system, a support base, a detachable interior shelf and dividing wall, and a collapsible and/or detachable carrying handle.

2. Description of the Related Art, including information disclosed under 37 CFR 1.97 and 1.98 includes the following documents:

Cabinets with swinging covers U.S. Pat. No. 806,277; Issue date, Dec. 5, 1905,

Tray fastened to shower wall; U.S. Pat. No. 2,876,908; Issue date: Mar. 10, 1959.

Garment hanger attached to shower pipe; U.S. Pat. No. 2,941,671; Issue date: Jun. 21, 1960.

Plastic soap tray which hangs from shower pipe; U.S. Pat. No. 3,059,374, Issue date: Oct. 23, 1962.

Shower caddy hanging from pipe; U.S. Pat. No. 3,184, 702; Issue date: May 4, 1965.

Hook or soap dishes attached to shower pipe; U.S. Pat. No. 43,266,764; Issue date: Aug 16, 1966.

Wire caddy with wire bent to fit around shower pipe; U.S. Pat. No. 3,789,996; Issue date: 1974.

A caddy having a cabinet and suction cups; U.S. Pat. No. 3,869,183; Issue date: 1975.

A wire shelf structure adapted to be supported from a shower arm; U.S. Pat. No. 4,387,811, Issue date: Jun. 14, 1983.

An open rectangular frame with object-storing trays slidably and rotatably mounted in spanning relation between the long sides of the frame, and the same is effective to vertically suspend the frame from a shower nozzle or the like, and thereby contribute to its functioning, as a shower accessory. U.S. Pat. No. 4,541,131; Issue date: Sep. 17, 1985.

Wire and plastic shower caddy; U.S. Pat. No. 5,180,067; Issue date: Jan. 19, 1993.

A carrying ease assembly is provided with a case defining an enclosed interior, and a collapsible handle assembly disposed within the case. U.S. Pat. No. 5,431,428; Issue date: Jul. 11, 1995.

Caddy for soap and hanging razors; U.S. Pat. No. 5,620, 105; Issue date: Apr. 15, 1997.

A safe cordless telephone with a hands-free speakerphone is provided for use in showers or when taking a bath. The user-friendly cordless telephone can be readily attached and removed from any portion of the shower/bath unit, including a shower wall, door, sliding panel, towel rack, bracket, holder, or shower head pipe. The shower speaker telephone can also have a radio, intercom, clock., and a display window to display the telephone numbers of outgoing and/or incoming telephone calls. U.S. Pat. No. 5,664,015; Issue date: Sep. 2, 1997.

A shower caddy for holding personal care articles including containers of preparations such as shampoo, hair conditioner, lotions, toothpaste and the like, and items such as shavers, toothbrushes and combs, includes a frame having generally vertically disposed structural elements, at lea ne and preferably two transversely disposed shelves, and a mirror, U.S. Pat. No. 6,581,790; Issue date: Jun. 24, 2003.

BRIEF SUMMARY OF THE INVENTIVE CONCEPT

The invention generally relates to an accessory storage system for access during showering or bathing, which includes a frame, a door, a handle assembly, a support, base, a hanger system, and a detachable shelf system.

Prior to explaining a preferred embodiment of the invention in detail, it is to be understood that the inventive concept is not limited in its application to the details of construction or to the arrangements of the components set forth in the following description of the preferred embodiment, or illustrated in the drawings. The invention is capable of other embodiments and of being practiced and carried out in various ways. Also, it is to be understood that the phraseology and terminology employed herein are for the purpose of the description and should not be regarded as limiting.

The primary object is to provide a Towel Shower Caddy that is primarily composed of at least one storage container, which may contain a towel or other items, may have a speaker and electronic communications devices, may attach above or below a shower head pipe, and may have the following detachable items: an exterior shelf, two hangers, four suction cups, a support base, an interior shelf and dividing wall, and a carrying handle.

Another object is to provide a Towel Shower Caddy that provides storage for a towel or other items used to cleanse or dry the body.

Another object is to provide a Towel Shower Caddy that provides storage for personal items, such as a razor, eyeglasses, a watch, a ring, a bracelet, at necklace, other items of jewelry, money, car keys, a cell phone, an MP3 player, or any other item that will fit in the compartment, including music listening devices such as an IPod.

Another object is to provide a Towel Shower Caddy that provides storage on a detachable shelf for items used to cleanse the body, such as bars of soap, liquid soap, shampoo, hair conditioner, body wash, or any other item used for cleansing the body.

Another object is to provide a Towel Shower Caddy that provides security and peace of mind for the owner because the towel and/or items stored stay in close proximity to the owner.

Another object is to provide a Towel Shower Caddy comprising a hanger system that may hang from a variety of interior or exterior locations such as a shower pipe, a bathtub faucet, or even a tree branch wherein detachable hangers or a lanyard connect to and support the apparatus.

Another object is to provide a Towel Shower Caddy comprising a hanger system that may be of unitary construction of the frame, detachable left and right hanger members, or a lanyard strap, loops, and carabiner combination.

Another object is to provide a Towel Shower Caddy that can be attached to a shower wall using the suction cups on the back of the structure, thus providing a secure storage environment.

Another object is to provide a Towel Shower Caddy that is portable; therefore the frame may be carried by the handle or by the hanger system, including utilizing detachable hangers. The handle, and/or suction cups, may be stored inside so that the device can be carried in and out of the shower and may be used indoors or outdoors.

Another object is to provide a Towel Shower Caddy that can be configured out of different materials such as, but not limited to, plastics, metals, wood, bamboo, other plant materials, stone, ceramics, or any other material suitable for construction including composite materials, waterproof materials, and combinations of materials.

Another object is to provide a Towel Shower Caddy that may be used in a variety of spaces, including residential and commercial shower enclosures, communal bathrooms such as those found in colleges and universities, outdoor showers in parks, or any other type of a shower or bathing enclosure or environment.

Another object is to provide a Towel Shower Caddy that may be used for storage anywhere, so it may be used in non-shower environments, such as hanging from a tree branch, a surf board fin, the rib of a beach umbrella, or even a hook on the side of a camper.

Another object is to provide a Towel Shower Caddy that provides storage on elevated support base members which elevate the storage container above a desk or dresser when a cabinet-style configuration is preferred.

Another object is to provide a Towel Shower Caddy that provides a space for ventilation of the bottom wall of the frame above a desk or dresser when a cabinet-style configuration is preferred.

Another object is to provide a Towel Shower Caddy that can be manufactured by injection molding or other molding or other methods in a variety of colors and styles, so that one part may be a different color or be made out of a different material than another part.

Another object is to provide a Towel Shower Caddy that can be further accessorized by adding components to the frame, such as a speaker, or other items such as a shelf, a cup holder, a hook, a battery, a light, a television, a mirror, a microphone, or any other convenience item or electronic device that may prove useful and complement the apparatus.

Another object is to provide a Towel Shower Caddy that provides a medium for advertising of items such as products or companies or corporations by sticking a decal onto the frame, molding a trademark or logo into the frame, or any other means of applying or adding advertising to the apparatus, including using different color combinations, patterns, or materials inside or outside of the apparatus.

Another object is to provide a Towel Shower Caddy that may be stored with the hanger members, the suction cups, the interior partition, and the handle inside the frame and the exterior shelf attached so that it is snug against the bottom wall of the frame, thus ensuring that one apparatus may be stacked on top of or next to another apparatus for commercial display purposes.

Another object is to provide a Towel Shower Caddy that allows the user to listen to sound through a speaker which is mounted or molded into the door or other part of the frame, thus ensuring that music, a cellphone call, an MP3 recording, or any other sound or audio wave, including sound from any portable electronic device, may be heard by the user.

Another object is to provide a Towel Shower Caddy that has several storage compartments such that items may be stored inside the frame, on top of a detachable shelf comprising a wire grid, on the top wall of the frame, or even items may be hung from the hangers or the detachable shelf or an other part of the apparatus.

Another object is to provide a Towel Shower Caddy that provides a display surface for a variety of items, so that any item, such as a stuffed animal or toy, may be placed in or on the apparatus and the apparatus may be placed anywhere, such as a residential bedroom.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE DRAWINGS

Various other objects, features and attendant advantages of the present inventive concept will become fully appreciated as the same become better understood when considered in conjunction with the accompanying drawings, in which like reference characters designate the same or similar parts throughout the several views. The figures represent the preferred embodiment of the inventive concept, primarily a rectangular frame, as follows.

DETAILED DESCRIPTION OF THE INVENTION

A. Overview

Figure 1:
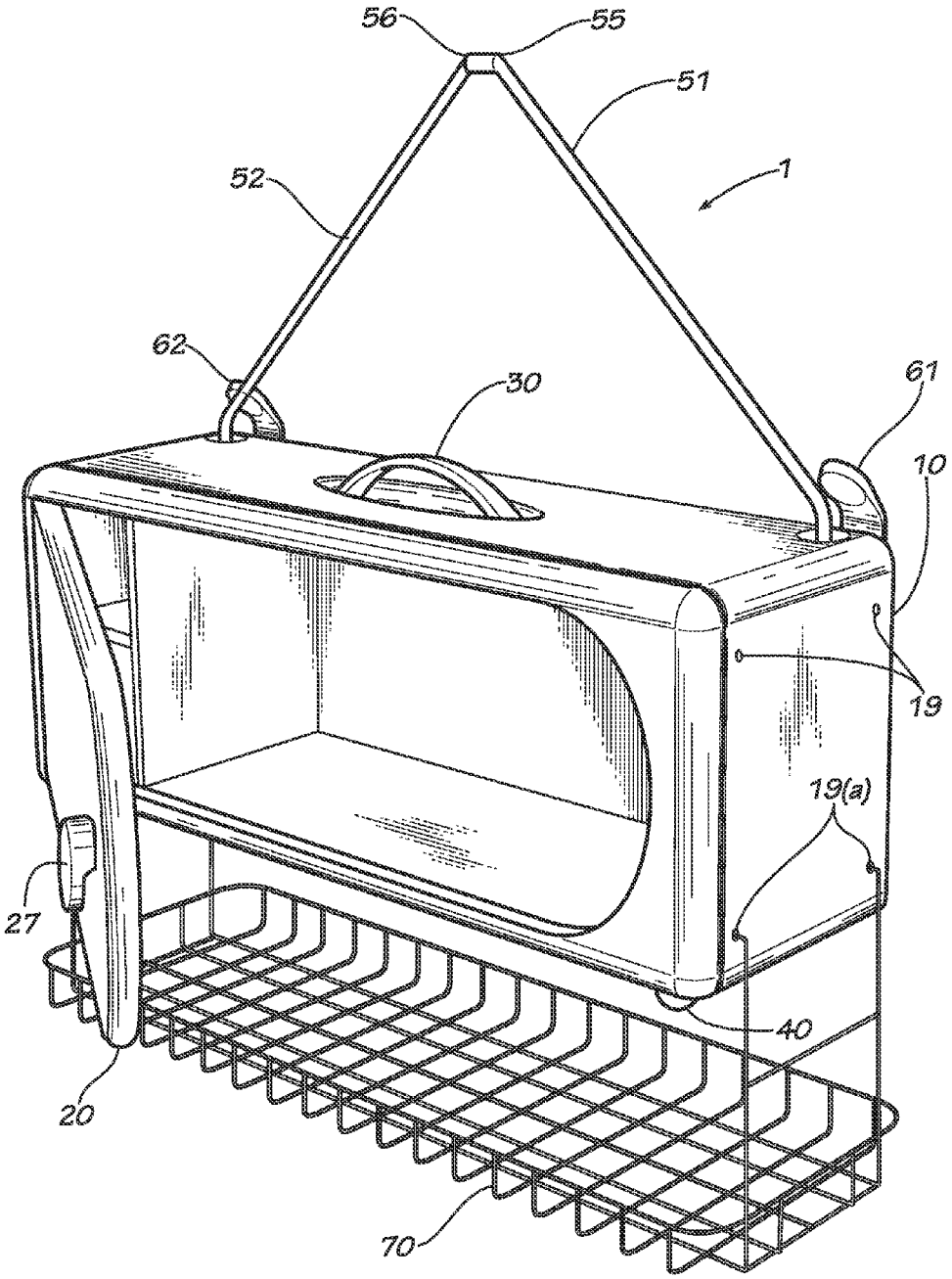
FIG. 1 presents a front-facing perspective view of the Towel Shower Caddy 1.

Beginning with FIG. 1, there is presented a generalized view of the inventive concept, showing, as major components of the preferred embodiment, a frame 10, a door 20, a handle assembly 30, four support pads 40, a removable hanger system 50, a hanger cover system 60, and a detachable shelf 70. Each of the foregoing major components further comprises sub-components that enhance their functionality.

B. Frame

Figure 2:
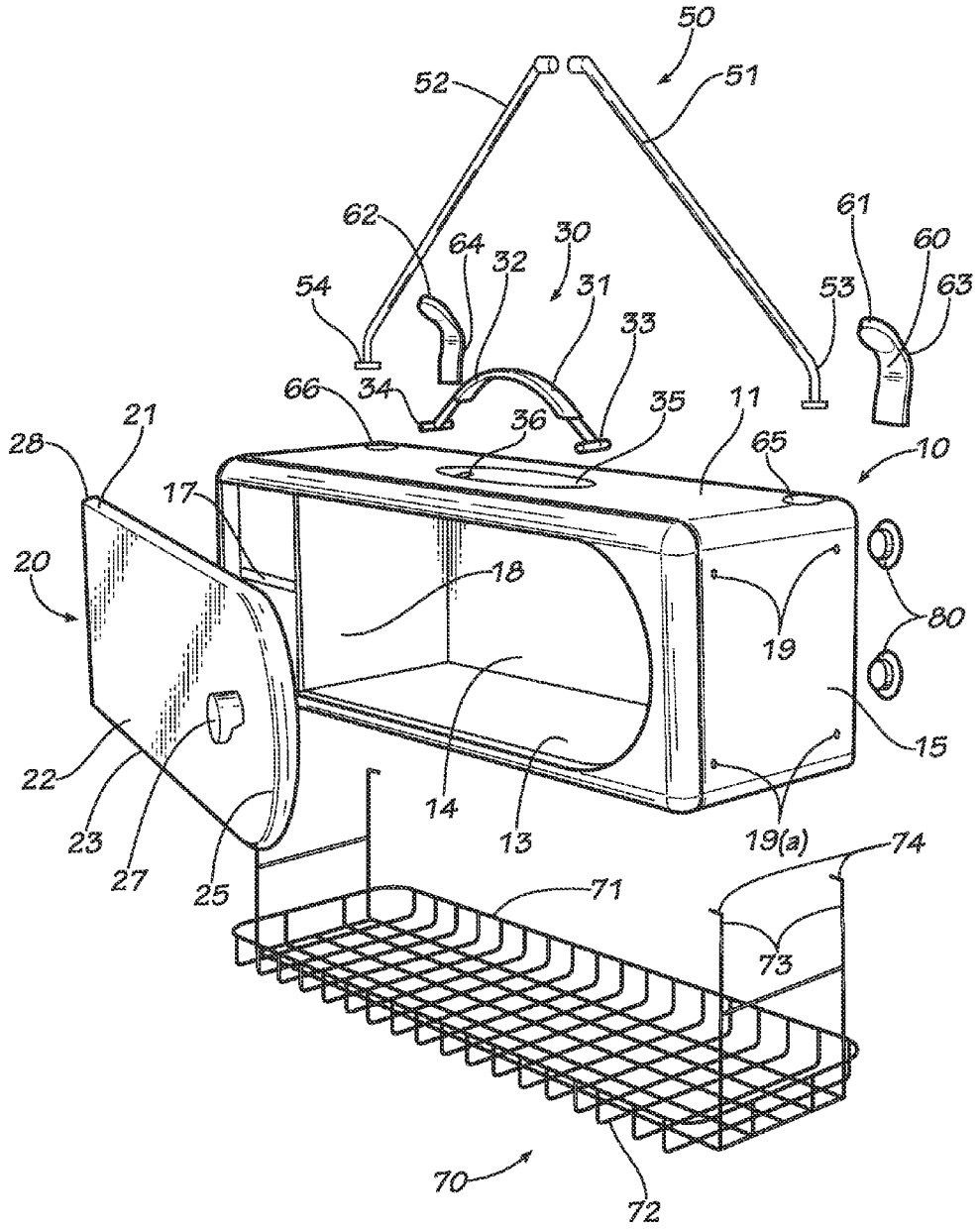
FIG. 2 shows an exploded perspective view of the inventive concept.

In viewing FIG. 2, there is illustrated an exploded view of the Towel Shower Caddy 1, The fame 10, is shown to be a container with a planar door 20 that opens to reveal an interior shelf 17 and an interior wall 18. The frame 10 has indentations 19 and 19(*a*) on the left side wall 15 and also the right side wall 16 (not shown). The function of the frame 10 is to provide a container for storage of various personal bathing items and electronic communications devices. The indentations 19, 19(*a*) serve to provide an anchor or insertion point for left and right attachment wires 74, themselves attached to the shelf system 70.

The preferred embodiment of the frame 10 is a generally rectangular cuboid, open-volume structure of six surfaces: a top wall 11, a front wall 12, a bottom wall 13, a back wall 14, a left side wall 15, and a right side wall 16. The surfaces are joined together as a frame 10 to form the container. The attached door 20 opens to make accessible an interior storage compartment with a shelf 17, separated by a vertical wall 18 which divides the compartment into several sections. A variety of assorted items may be placed into each section. The frame 10 may be composed of a waterproof material, which may include different plastic or elastomeric compounds.

The door 20 can be closed to provide an enclosed waterproof secure area. The frame 10 may be configured in several different shapes, such as square, oval, or any other geometric shape, or colors, and may be manufactured with different materials. For example, a red frame 10 may have blue handles 30 and a black detachable shelf 70 or the frame 10 may be plastic with a bamboo detachable shelf 70 and bangers 50 made from a woven rope or a flexible lanyard. The interior of the frame 10 may be manufactured from different materials or color.

C. Door

Figure 3:
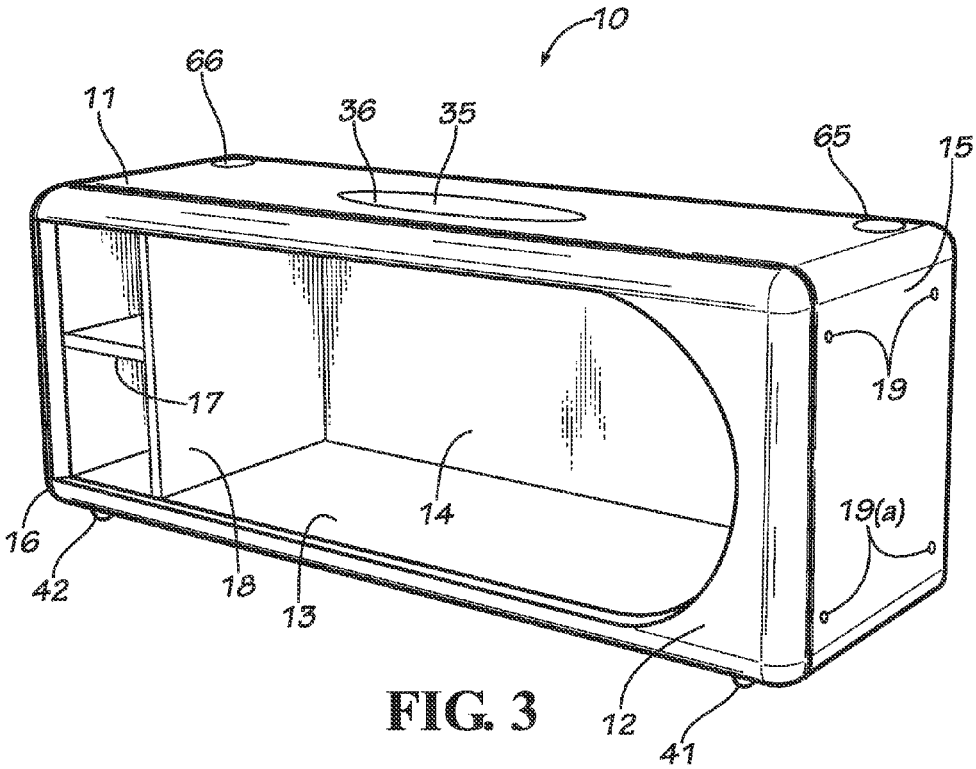
FIG. 3 displays a frontal view of the frame 10.
Figure 4:
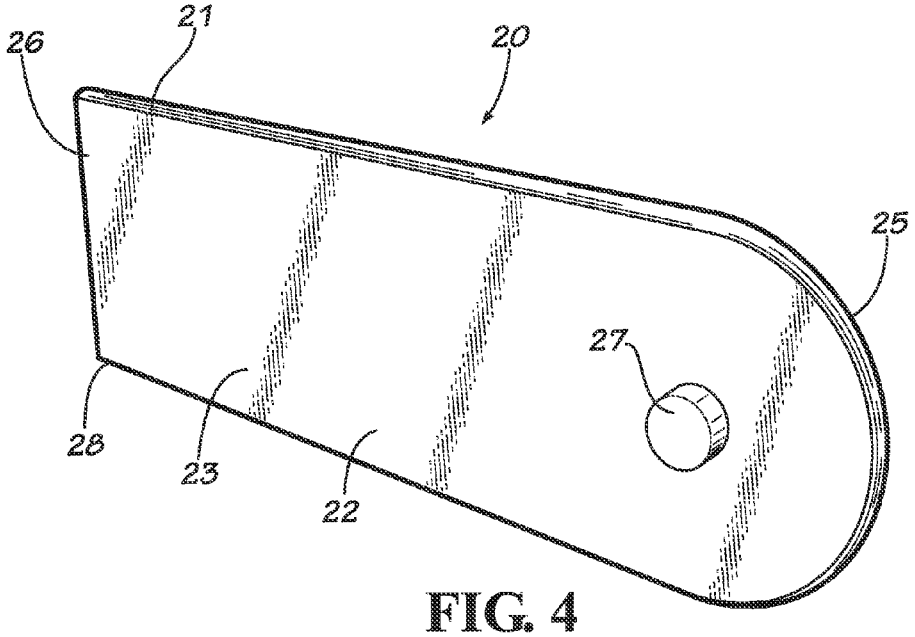
FIG. 4 is a view of the front of the door 20.
Figure 17:
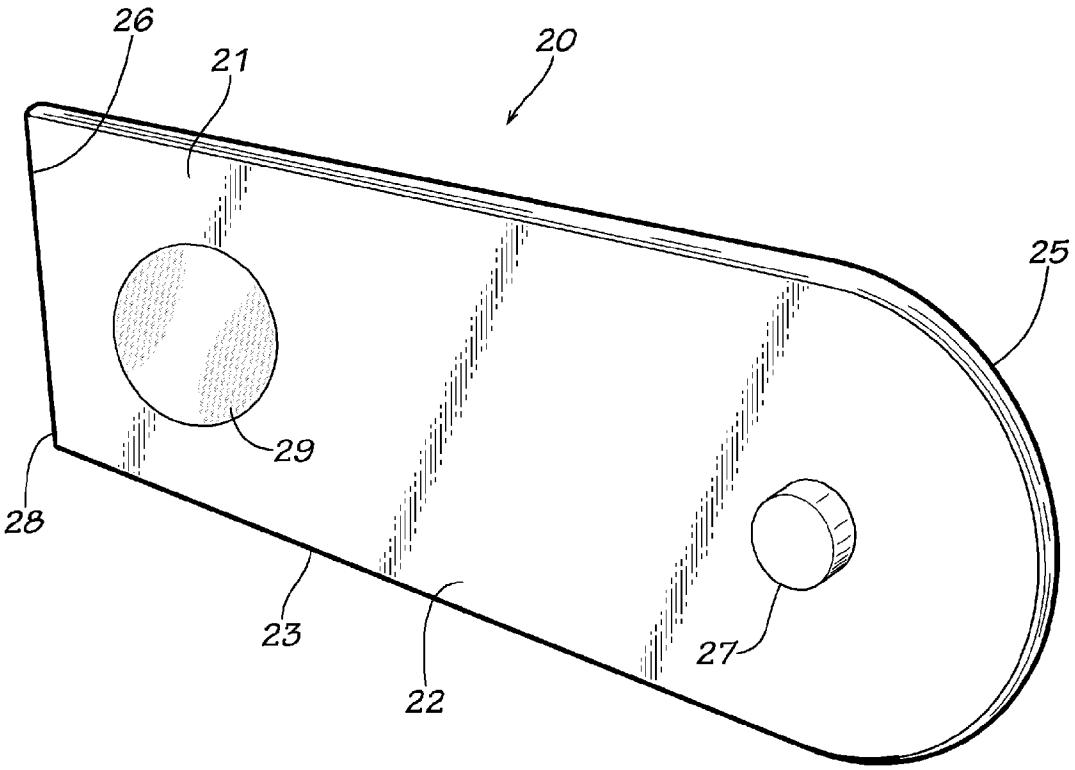
FIG. 17 shows the door 20 further comprising a speaker 29 and knob 27 attached.

The embodiment of the door 20, as shown in FIG. 4, is pivotally attached to the frame 10 with an attaching flange 28. The door 20 further has a knob 27, and may have a speaker 29 positioned on or within the planar surface of the door 20 (ref. FIG. 17). The function of the door 20 is to cover the opening to the frame 10 (shown in FIG. 3) and securely protect any items stored within from splashing water. The door 20 may also be constructed with a waterproof, compressible material encompassing the outer perimeter of the door 20.

The door 20 is an elongated planar structure of six surfaces, the top surface 21, the front surface 22, the bottom surface 23, the back surface 24, the left side surface 25, and the right side surface 26, which unitarily form a planar surface composed of a waterproof material, which may include elastomeric materials. The door 20 is attached to the frame 10 with an attaching flange 28. The door 20 opens to reveal an interior storage compartment. The door 20 can close to provide an enclosed waterproof secure area within the frame 10. A knob 27 on the front surface 22 allows for ease in opening or closing. The door 20 may be configured with at least one speaker 29 in a different shape, such as a square, a rectangle, an oval, or any other shape, or color. The speakers 29 may be manufactured with different materials. For example, a red plastic door 20 may have a square black metal and cloth speaker 29.

The door 20 may be configured in different shapes, such as square, rectangular, oval, or any other shape, or color and may be manufactured with materials that are different from the materials used for the other elements. The function of the door 20 is to allow access to items which are stored inside the frame 10 when the door 20 is opened and to keep those items secure and waterproof when the door is closed.

D. Handle Assembly

Figure 5:
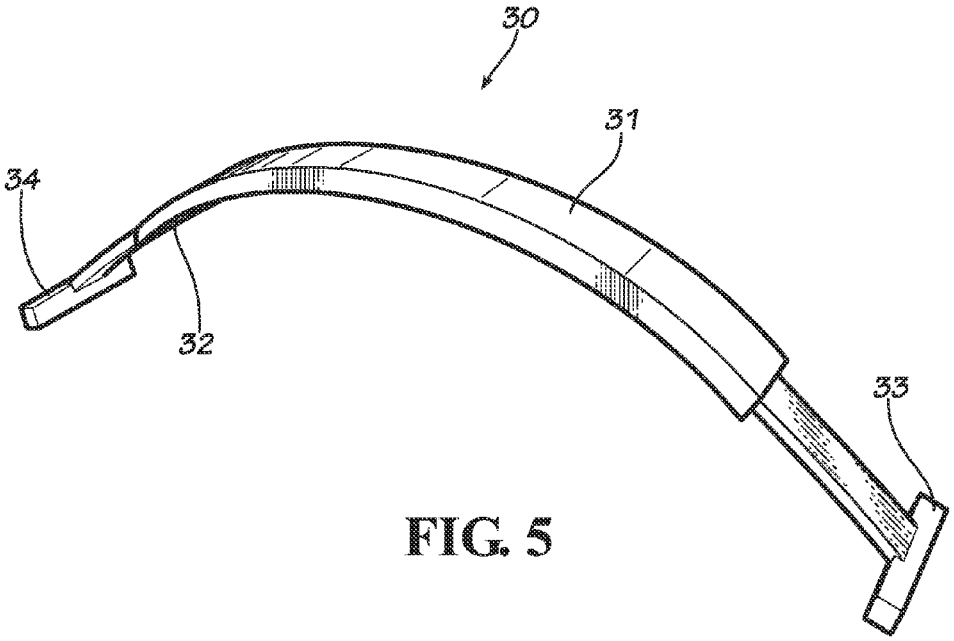
FIG. 5 illustrates a perspective view of a handle assembly 30.
Figure 14:
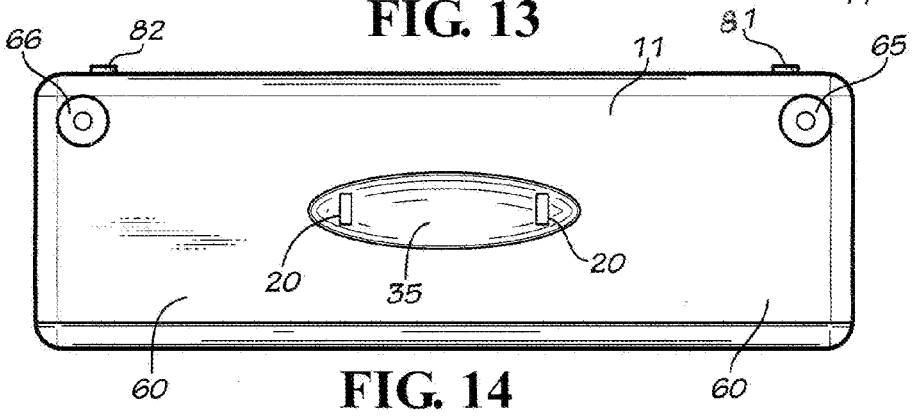
FIG. 14 displays the top view of the frame 10 showing the top wall 11.
Figure 20:
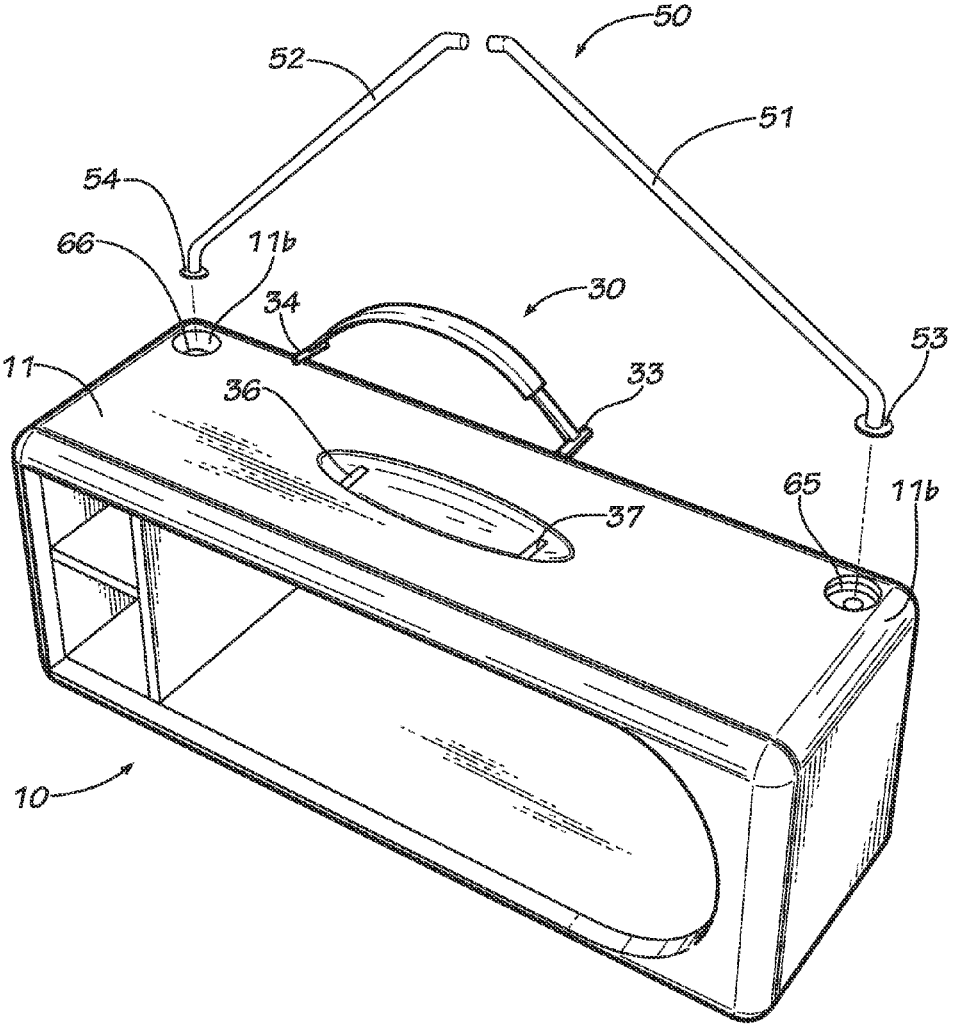
FIG. 20 presents an exploded view of the frame 10 in an embodiment featuring a detachable handle assembly 30 and a detachable hanger system 50.
Figure 21:
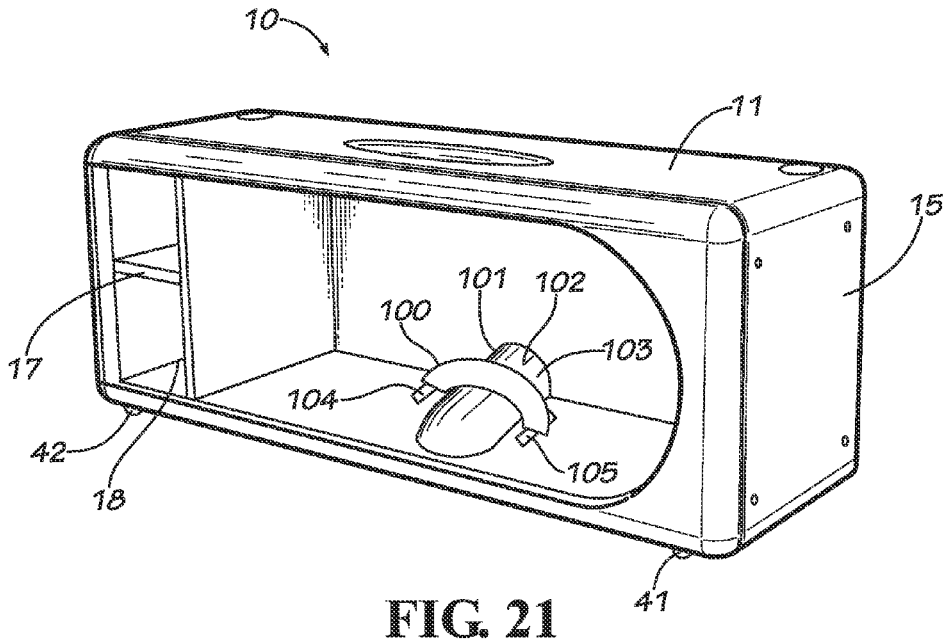
FIG. 21 is a front view of an embodiment of the frame 10 having a Velcro® component for support of the frame 10 upon a shower pipe.

In FIG. 2, and with more detail, in FIG. 5, a detachable handle assembly 30 is shown. The handle assembly 30 comprises a flexible elongated structure composed of a top surface 31, a bottom surface 32, a left end 33, and a right end 34. The handle assembly 30 further comprises a left end 33 and a right end 34. The handle left end 33 and the handle right end 34 fit into left and right housing slots 37, 36, respectively, which slots are molded into the housing cavity 35 of the top all 11, as shown in FIG. 14 and FIG. 20. In this manner, the handle left end 33 and the handle right end 34 remain inside the frame when the structure is grasped. The handle assembly 30 may be grasped by one or both hands of a user when the apparatus is to be carried. The handle assembly 30 may collapse or be detached by the user whenever necessary.

The function of the handle assembly 30 is to support the weight of the frame 10 and any other elements attached to the frame 10, including the door 20, the support base 40, the hangers 50, the hanger covers 60, the detachable shelf 70, and any contents of the shower caddy 1. The handle assembly 30 may be composed of a waterproof material, which may include different plastic compounds. The handle assembly 30 is collapsible so that it may be pushed downward and lie flat against the housing cavity 35, thus facilitating storage of the container (as shown in FIG. 1. Further, the handle assembly 30 arches upward and flexes when it is grasped by a user's hand, thus allowing transport of the towel shower caddy 1. The handle assembly 30 may be configured in different shapes, such as square, rectangular, oval, or any other shape, or color and may be manufactured with materials that are different from the materials used for the other elements.

The handle assembly 30 may also comprise a one-piece structure permanently attached to the frame 10 by means of injection molding technique. In this instance, the handle assembly 30 is not retractable into the top surface of the frame 10.

E. Hanger System

Figure 6:
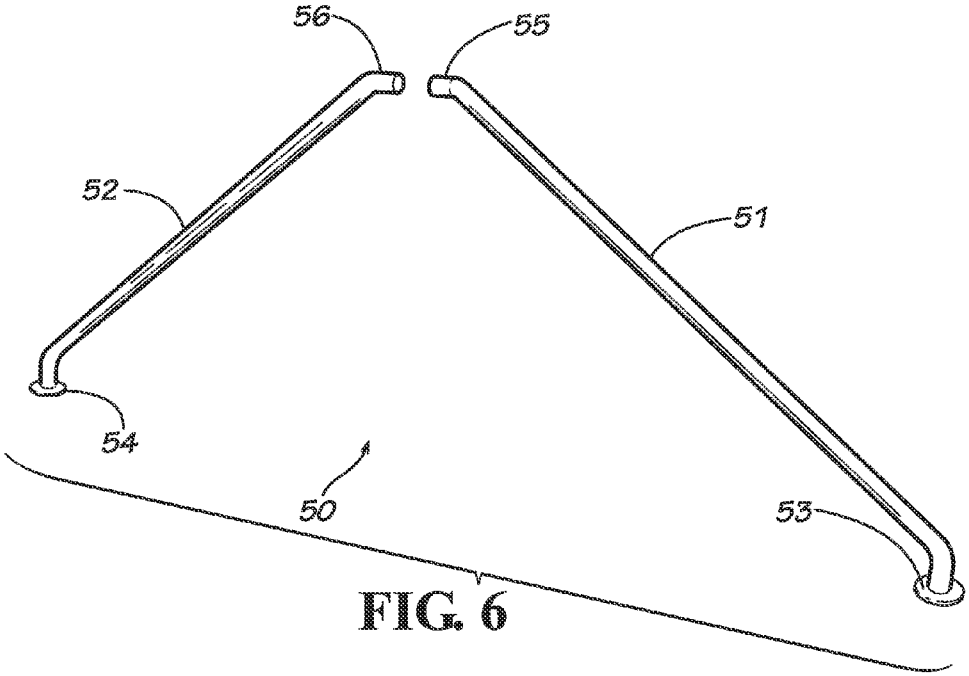
FIG. 6 presents a perspective view of the two-member hanger system 50.

A particular embodiment of the inventive concept is a hanger system 50, as shown in FIG. 6. There illustrated is a removable hanger system 50 comprising two elongated tubular structures, being a left member 51 with a stopper end 53 and a receiving end 55, and a right member 52 with a stopper end 54 and an engaging end 56.

Figure 7:
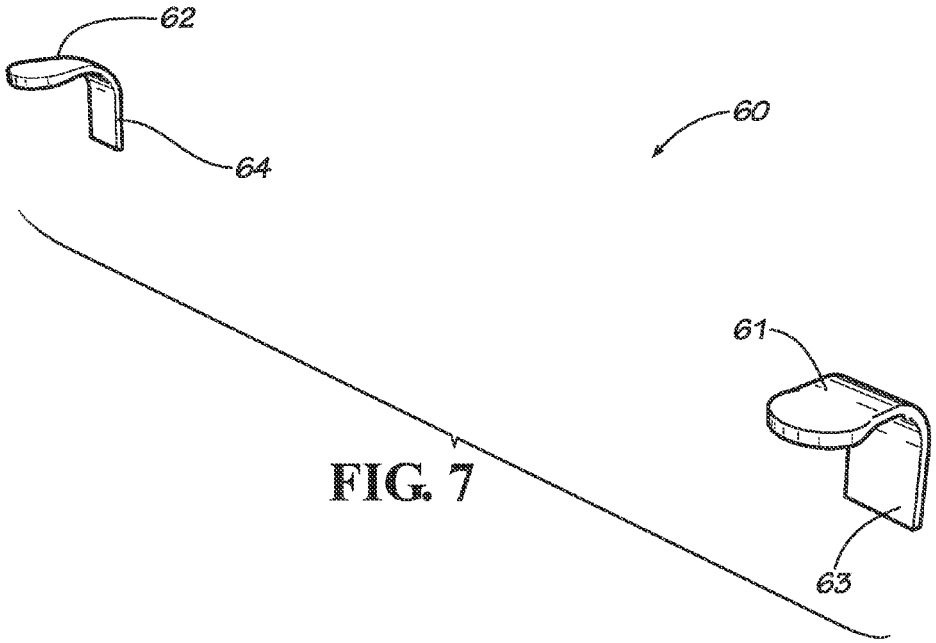
FIG. 7 is a display of the two hanger covers 60 in a preferred embodiment.

The two hanger members 51, 52, may be composed of a waterproof material, which may include different plastic compounds. The hanger system 50 is inserted into the frame 10 through the open door 20 as previously pointed out in FIG. 2. The left hanger receiving end 55 and the right hanger engaging end 56 are respectively inserted, through the left frame hole 65 and the right frame hole 66, respectively. To accomplish this, the hanger covers 60, shown in FIG. 7, must also be opened. The left member 51 fits through the hole next to the left hanger cover flap 61 (ref. FIG. 7) and the right member 52 fits through the hole next to the right hanger cover flap 62 (ref. FIG. 7).

The hanger system 50 may extend out of the frame holes 65, 66 in the top wall 11 (ref. FIG. 3) so that the left stopper end 53 covers the left frame hole 65 in the top wall 11 and the right stopper end 54 covers the right frame hole 66 in the top wall 11 when fully extended.

The left hanger receiving end 55 fits into the right hanger engaging end 56 so that the left hanger member 51 may be screwed into the right member 52, thus forming a complete hanger assembly system 50. The hanger system 50 is sturdy enough to support the weight of the frame 10 and any other elements attached to the frame 10.

The hanger system 50 may be configured in different shapes, such as square, rectangular, oval, or any other shape, or color and may be manufactured with materials that are different from the materials used for the other elements. The function of the hanger system 50 is to support the weight of the frame 10 when the frame is hung from a support, such as an indoor shower pipe, shower head, towel bar, bathroom fixture, or even an outdoor tree limb or a bracket on a camper. The hanger system 50 is inserted into the frame 10 through the open door 20 and extended up through a hole created by the opened hanger covers 60. The hanger members 51, 52 should be pulled through the respective frame holes 65, 66 until the stopper ends 53, 54 cover each hole.

The hanger system 50, optimally, is joined to form one continuous length by inserting the right hanger engaging end 56 into the left hanger receiving end 55 and rotating the engaging end 56 and receiving end 55 in corresponding directions until the connection is tightened, similar to screwing a lid onto a jar. The hanger system 50 supports the frame 10 when the frame 10 is hung from a surface, such as an indoor shower pipe, shower head, or a towel bar or other bathroom fixture, or even an outdoor tree limb or a bracket on a camper.

Another embodiment of the hanger system 50 comprises a lanyard of fabric or other flexible material. The lanyard may be attached to two integral hooks, one hook each permanently built into the frame 10 at the previously-shown locations of the two frame holes 65, 66. The lanyard is connected to the hooks by means of two carabiners attached to each end of the lanyard. Further, there may be two additional hooks built into the frame 10 at the respective left and right ends of the bottom wall 13 of the frame 10.

F. Hanger Cover System

The hanger cover system 60 is illustrated in FIG. 7, (and also in FIG. 2), and comprises orthogonally-bent, flat structures or flaps 61 and 62, each with an attachment 63 and 64 to hold them, respectively, to the frame 10. The function of the hanger cover system is to cover the left frame hole and right frame hole, 65, 66 respectively in the frame 10 when the hanger system 50 is not in use. The hanger cover system 60 is composed of a waterproof material, may include different plastic or elastomeric compounds.

By referring, to FIG. 1 and FIG. 2, it can be seen that the hanger system 50 is inserted into the frame 10 through the open door 20 and extends up through holes created by the opened hanger cover system 60. The left member 51 fits through the hole next to the left hanger cover flap 61 and the right member 52 fits through the hole next to the right hanger cover flap 62. The hanger cover system 60 may stay in a closed position, covering the holes 65, 66 in the frame 10 when the hanger system 50 is not in use, and may stay in an open position, uncovering the holes 65, 66 in the frame, when the hanger system 50 is being utilized.

The hanger cover system 60 may be configured in different shapes, such as square, rectangular, oval, or any other shape, or color and may be manufactured with materials that are different from the materials used for the other elements.

G. Support Base

Figure 15:
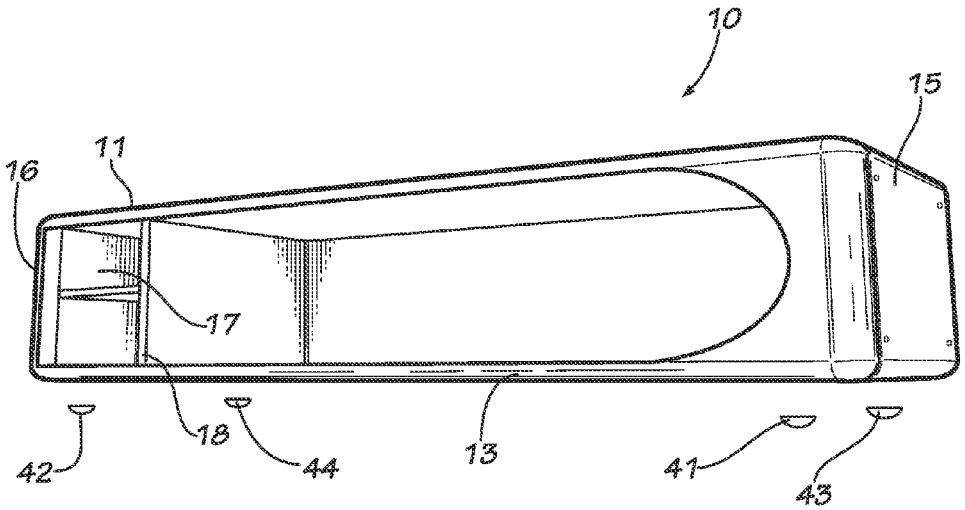
FIG. 15 is a perspective view of the apparatus showing the frame 10 and the support base system, 41-44.
Figure 16:
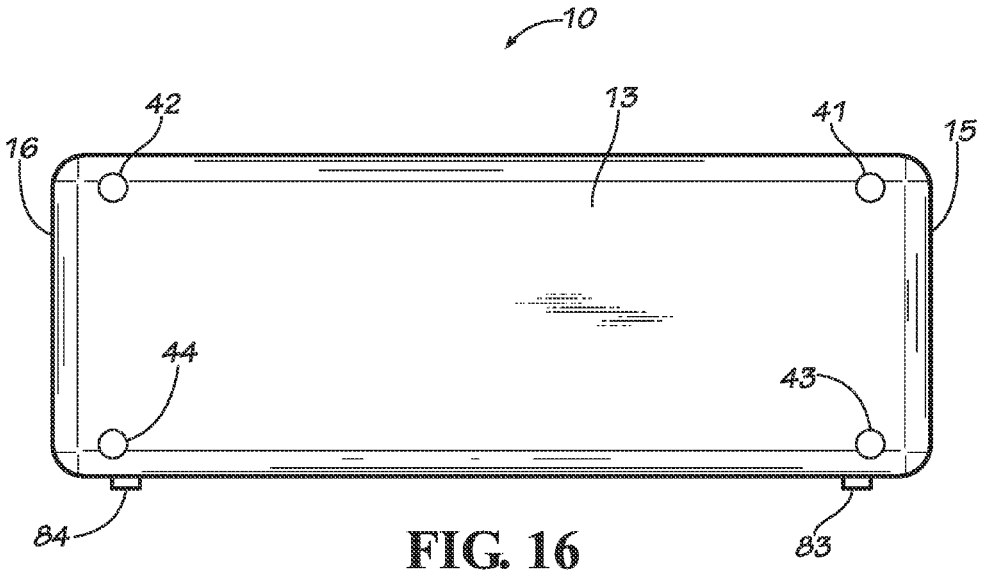
FIG. 16 is a bottom view of the frame 10 with the support base members 41-44 attached.

In FIG. 15 and FIG. 16, there is illustrated a support base system 40, comprising four round bottom supports or feet, being, a front left foot 41, a front right toot 42, a rear left toot 43, and a rear right foot 44. The components of the support base system 40 are attached to the bottom wall 13 of the frame 10. The function of the support base system 40 is to support, elevate, and ventilate the frame 10 and other elements attached to the frame 10.

The support base system 40 may be composed of a waterproof material which may include different plastic compounds or elastomeric materials. The support base system 40 may be configured in different shapes, such as square, rectangular, oval, or any other shape, or color and may be manufactured with materials that are different from the materials used for the other elements of the Towel Shower Caddy 1. The function of the support base system 40 is to keep the frame 10 from touching a shelf or other surface when it is stored, and to support the weight of the frame 10 when the hanger system 50 is not in use.

H. Detachable Shelf System

Figure 8:
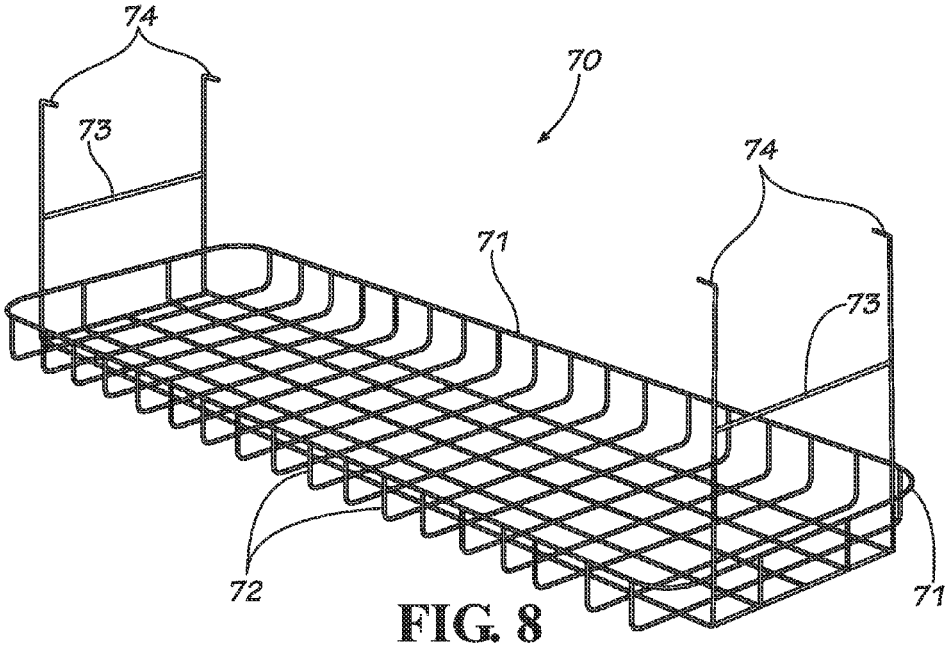
FIG. 8 is a view of a detachable shelf system 70 comprising an orthogonal wire grid.

The preferred embodiment of the detachable shelf system 70, as illustrated in FIG. 8, and previously shown in FIG. 2, is a removable, basket-like grid composed of interconnected wire and/or plastic-coated wire 71. Further, there is a bottom grid 72, attached together by grid support wires 73. The detachable shelf system 70 may be attached to, or detached from, the frame 10 by means of attachment wires 74 which fit into small indentations 19, 19(*a*) (Ref. FIG. 1, FIG. 2) in the side walls 15, 16 of the frame 10. The dimensions of the detachable shelf 70 allow storage of a bath towel, and also provides for storage for a period of time.

The detachable shelf system 70 may be composed of metal wires covered with any of a variety of waterproof materials, which may include different plastic compounds. The detachable shelf system 70 may also be composed of plastic, rubber, bamboo, wood, or any other compound or material. The detachable shelf system 70 may be attached to the frame 10 with attachment wires 74 which fit into small holes in the side of the frame 10 or it may be detached from the frame 10. The detachable shelf system 70 may be attached to the frame 10 in two positions, either close to the frame 10 for transport or farther from the frame 10 for storage of personal items, such as bottles of shampoo or conditioner or bars of soap. If the detachable shelf system 70 is attached for transport, the attachment wires 74 fit into the indentations 19 closest to the top of the frame 10, so that the wire grid 72 fits snugly under the frame 10 with no clearance for item storage. If the detachable shelf system 70 is attached for actual use, the attachment wires 74 fit into the holes 19(*a*) closest to the bottom of the frame 10, so that the wire grid 72 fits under the frame 10 with clearance for storage of bottles and other items.

The detachable shelf system 70 may be configured in different shapes, such as square, rectangular, oval, or any other shape, or color and may be manufactured with materials that are different from the materials used for the other elements. Another embodiment of the detachable shelf system 70 may be a flexible mesh bag or other similar structure with a means for attaching the bag to the frame 10 of the Towel Shower Caddy 1.

I. Suction Cup System

Figure 9:
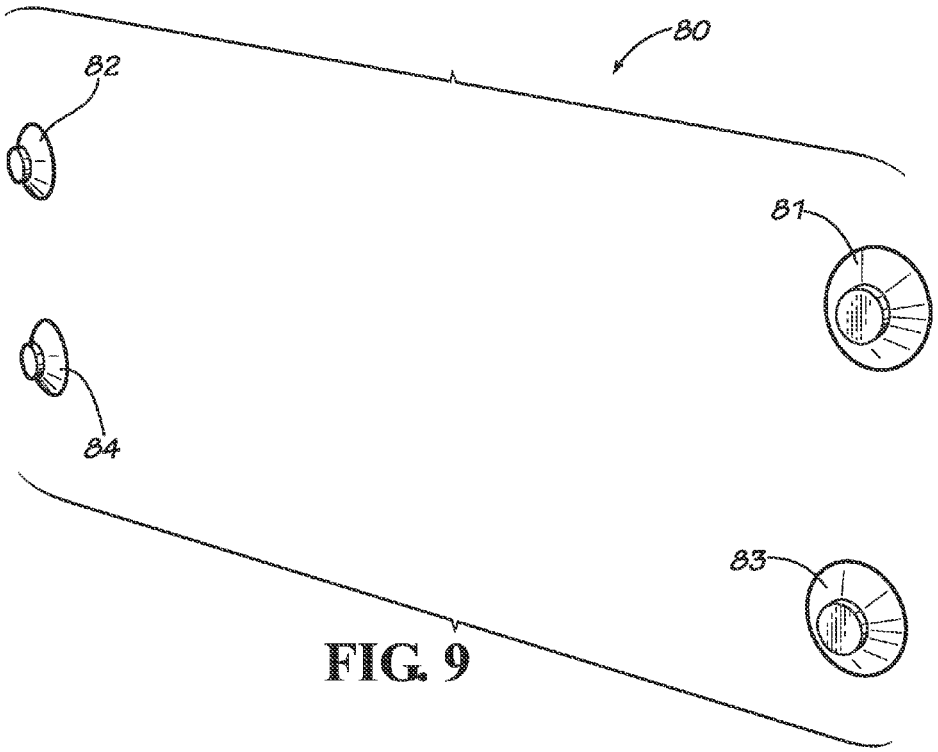
FIG. 9 is a view of the arrangement of suction cups 80 utilized in the device.

As shown in FIG. 9, the suction cup system 80 consists of four components: a left upper suction cup 81, a right upper suction cup 82, a left lower suction cup 83, and a right lower suction cup 84, all of which are attached to the back wall 24. When removed, the suction cup system 80 may fit through holes in the back wall 14. The function of the suction cup system 80 is to secure the back wall 14 of the Towel Shower Caddy 1 to a shower wall, or other flat vertical surface. The four suction cups 81, 82, 83, 84 are composed of a waterproof material, which may include any of a variety of different elastomeric materials.

The suction cup system 80 may be configured in different shapes, such as square, rectangular, oval, or any other shape, or color and may be manufactured with materials that are different from the materials used for the other elements.

Alternative Embodiments of Invention

The frame 10 may be a different shape, round or square or octagonal, or it may be a different size, of any dimensions that may be preferred by a manufacturer of the inventive concept. The frame 10 or door 20 may have school or team or corporate logos or trademarks on it or pressed or fabricated into it. The door 20 may be a different shape, constructed in a variety shapes, including circular, square or octagonal, and also may be of varying dimensions, depending on the judgment and preference of any manufacturer of the inventive concept.

An electronic music, radio, or communications system may be built into the frame 10 or door 20 or connected to the detachable shelf system 70 so that speakers 29, batteries, a television, any other type of electronic screen, or an other electronic item such as an I-Pod or a cell phone may be incorporated into the door 20 or frame 10 of the inventive concept. Further, flexible straps may be incorporated into the interior walls and dividers of the frame 10 so as to provide support for electronic devices, particularly cell phones or audio devices.

Operation and Use of Preferred Embodiment

The inventive concept, in its compacted, stored configuration, may contain several of its components packed into the interior of the basic frame 10. All the device components shown in the exploded view of FIG. 2, other than the door 20 and the detachable shelf 70, may be packed within the frame 10, for storage or commercial packaging. A purchaser or initial user picks up the towel shower caddy 1, seen in FIG. 2, having indentations 19, 19(*a*) on both the left side wall 15 and right side wall 16 (not shown), The door 20 is then opened, by means of the knob 27, to reveal an interior shelf 17 and an interior wall 18, two hanger covers 60, and a support base, as seen in FIG. 2 and FIG. 15. As shown in FIG. 16, the base comprises a front left foot 41, a front right foot 42, a rear left foot 43, and a rear right foot 44, which are all attached to the bottom wall 13.

Figure 18:
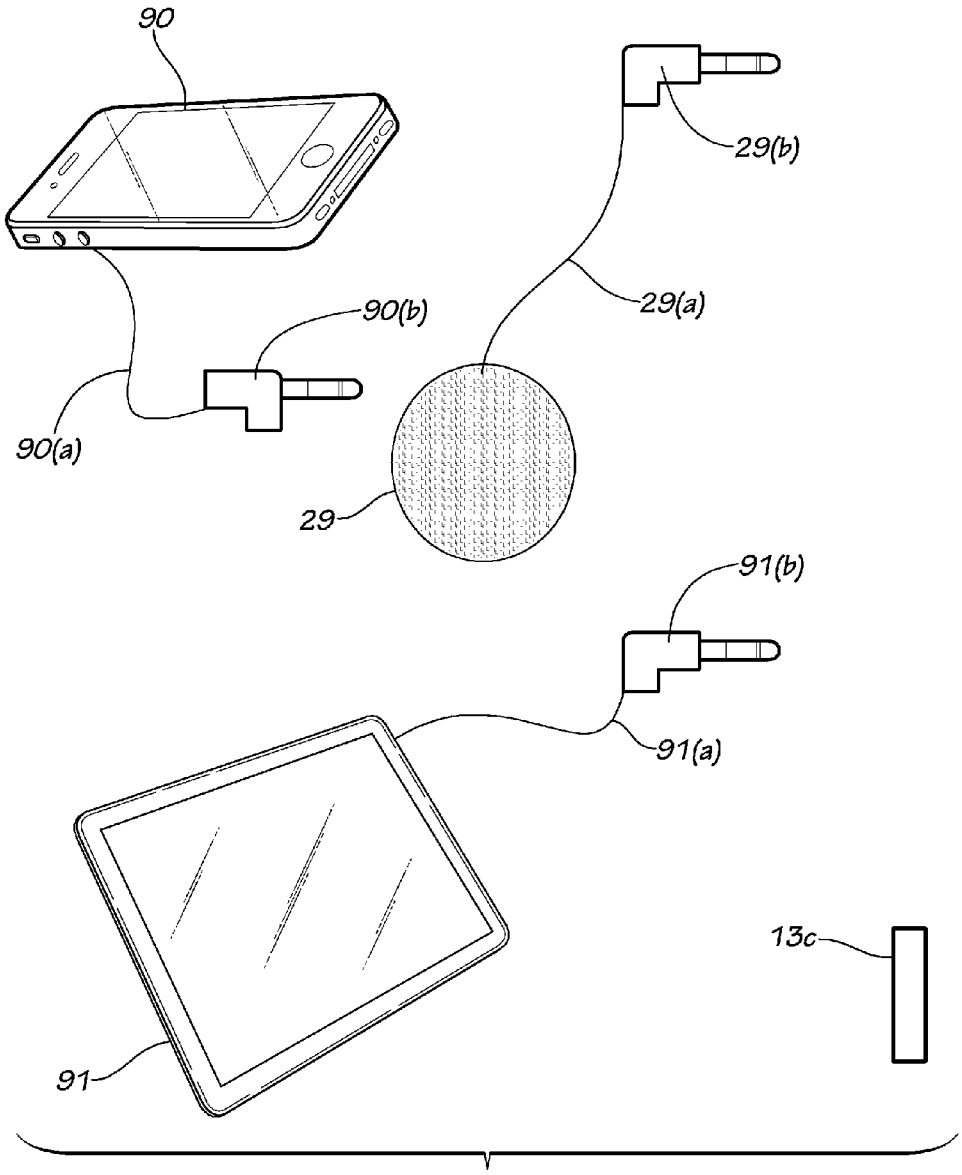
FIG. 18 illustrates alternative components, including a cellphone 90, accessories, 90(*a*), (*b*), speaker 29, speaker wire 29(*a*), speaker plug 29(*b*), electronic tablet 91, wire 91(*a*), jack 91(*b*), and a fastening means 13(*c*).
Figure 19:
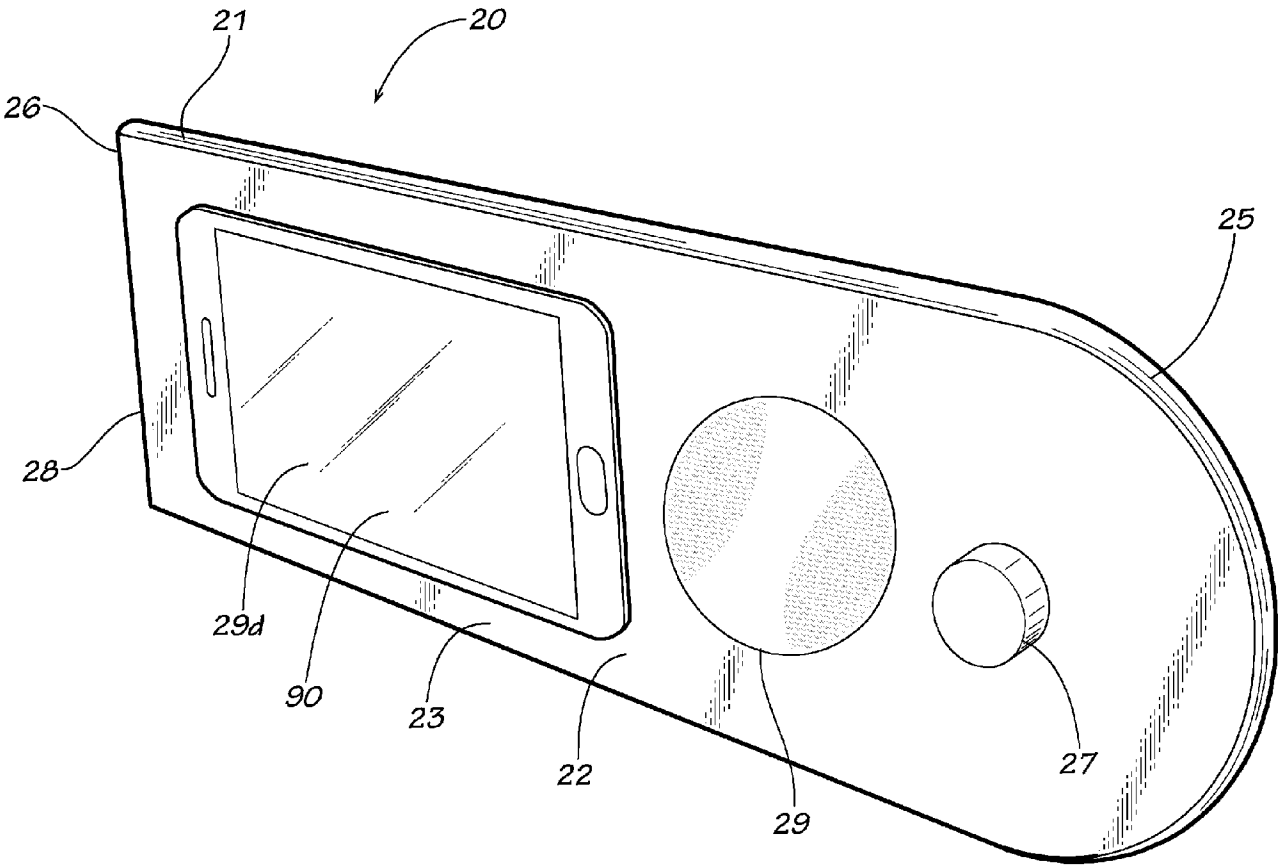
FIG. 19 displays an embodiment of a door 20, knob 27, and further, having a speaker (29) and an integral cellphone 90.

The door 20 may have a speaker 29, shown in FIG. 18, which is positioned on or integral to the door 20, as seen in FIG. 17. The handle assembly 30 is an elongated structure composed of a top surface 31, a bottom surface 32, a left end 33, and a right end 34, as seen in FIG. 2 and FIG. 5. Assuming these components have been stored, the user fits the handle assembly 30 into two slots 35, 37 within the housing cavity 35 on the top wall 11 in FIG. 14 to carry the apparatus 1 to a shower or other location.

Again, assuming the device war priorly stored, the user opens both flaps 61, 62, of the hanger cover system 60 exposing the two frame holes, 65, 66 respectively, in the top wall 11, as shown in FIG. 2. In referring to FIG. 6 and FIG. 2, the two members of the hanger system 50 are then inserted into the frame 10 interior, with the left member 51 and right member 52 of the hanger system 50 being inserted through their respective frame holes 65, 66. The user pulls each hanger member 51, 52, through the holes 65, 66 in the top wall 11 so that the left hanger stopper end 53 covers the left hole in the top wall 11 and the right hanger stopper end 54 covers the right hole in the top wall 11. The user attaches the left hanger receiving end 55 to the right hanger engaging end 56 with a rotating motion to gradually secure a fit between the two ends. The hanger system 50 now may be used to hang the frame 10 from a projection such as a shower pipe.

Figure 11:
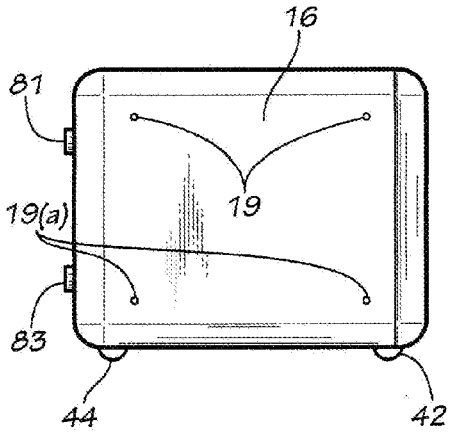
FIG. 11 is a right side view of the frame 10 showing the right side wall 11.
Figure 12:
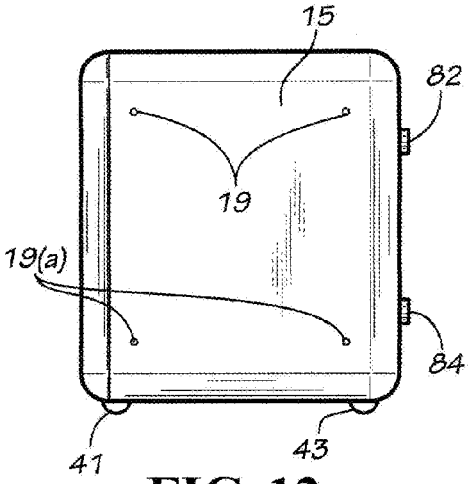
FIG. 12 shows the left side wall 12 of the frame 10.
Figure 13:
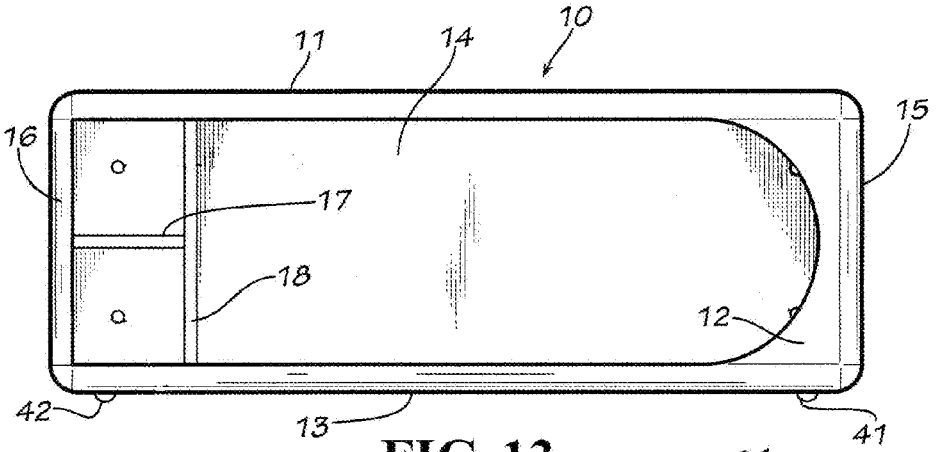
FIG. 13 is an alternative embodiment of the interior of the frame 10, with the door 20 unattached.

The user attaches the detachable shelf 70 shown in FIG. 8 to the frame 10 with the attachment wires 74 which fit into the lower indentations 19(*a*) in the left side wall 15 and the right side wall 16 as shown in FIGS. 11 and 12. This configuration allows for additional storage of items on the wire grid 72 directly below the frame 10.

Figure 10:
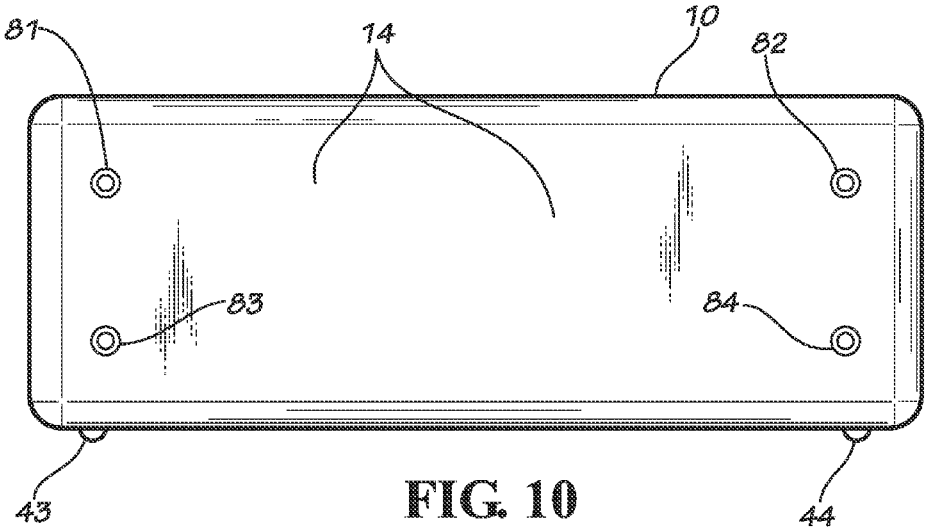
FIG. 10 is an alternative embodiment, which shows the rear view of the frame 10 with the suction cups 81-84 attached to the back wall 14 of the frame 10.

The user places four suction cups 80, a left upper suction cup 81, a right upper suction cup 82, a left lower suction cup 83, and a right lower suction cup 84, seen in FIG. 9 to the back wall 14, as seen in FIG. 10.

In the preferred embodiment, the user carries the Towel Shower Caddy 1 into a shower compartment by grasping the handle assembly 30 and places the apparatus hanger system 50 over an existing shower pipe so that the weight of the apparatus rests on the shower pipe. The user then secures the back wall 14 to the shower wall by pressing the suction cups 80 against the shower wall until there is suction and the apparatus is stationary.

In the event the Towel Shower Caddy 1 must be used in a shower enclosure having an angled, exposed shower pipe 2, the bottom wall 13 of the apparatus may be constructed with a half-cylindrical form 101-103, which form also extends to a portion of the back wall 14, as shown in FIG.

Figure 22:
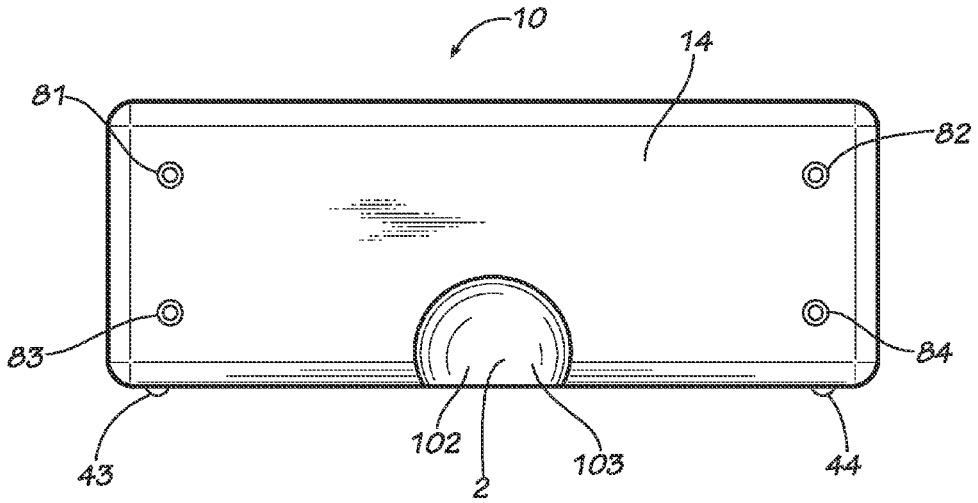
FIG. 22 is a view of the back wall 14 showing suction cups 81-84, and a cylindrical indentation 2 in the frame 10.
Figure 23:
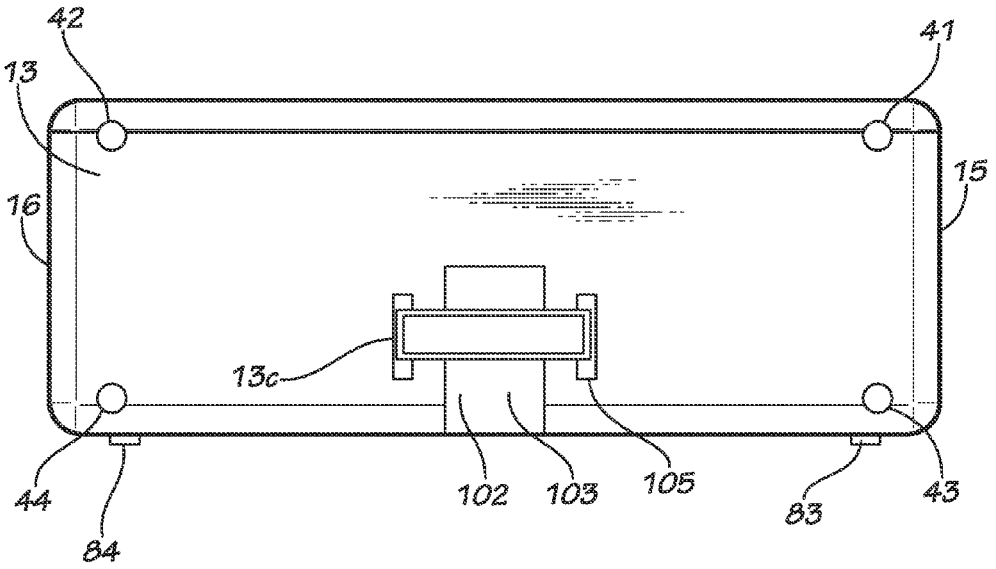
FIG. 23 illustrates the bottom wall 13 of the frame 10 further showing having a Velcro® component 13(*c*) for securing the frame 10 upon a shower pipe.
Figure 24:
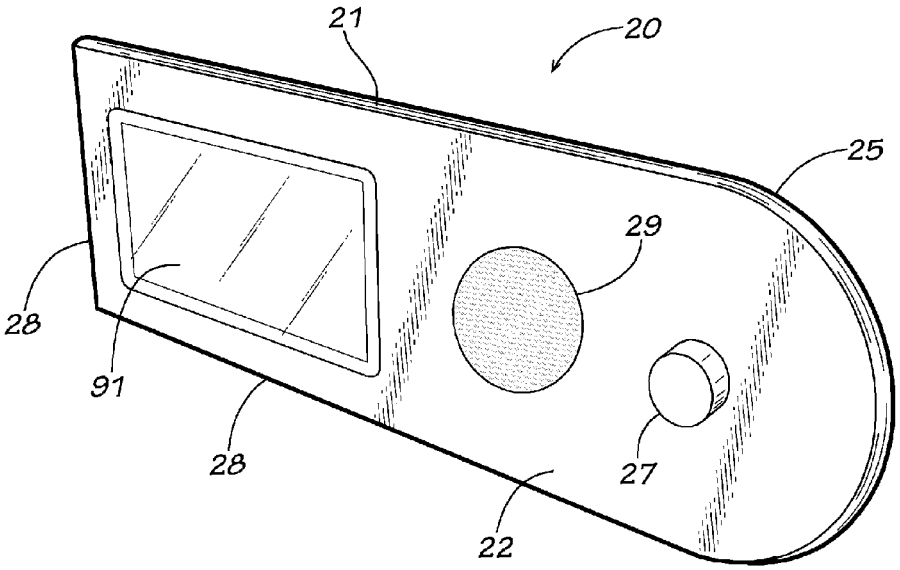
FIG. 24 displays an embodiment of a door 20 with a knob 27, and having a speaker 29 and an integral electronic tablet 91.

21 and FIG. 22. The Towel Shower Caddy 1 may then be secured to the shower pipe 2, by way of illustration, by means of a self-fastening mechanism 100 which may be a hook-and-felt type fastener 13(*c*) ("Velcro®") as shown in FIG. 23. The fastening mechanism is inserted around the shower pipe 2 through interior slots 104, 105 in the bottom wall 13 of the device. FIG. 23 illustrates a hook-and-felt type fastener 13(*c*) continuing through slot 105 on the underside of the bottom wall 13 of the device.

On those Towel Shower Caddies 1 so equipped, the user may then attach a portable electronic listening device, such as a cell phone or MP3 player to the speaker plug 29*b*, turn on the device so that the user hears sounds from the speaker 29, and rest the device on the interior shelf 17. The user rolls up a bath towel and inserts it into the larger space to the right of the interior wall 18.

The user places any items for storage onto or below the interior shelf 17 to the left of the interior wall 18 and closes the door 20 by pushing the knob 27 inward towards the frame 10. The user now places any other items, such as a shampoo bottle or a razor or bar of soap onto the bottom wire grid 72.

The apparatus now resembles FIG. 1 in appearance, which is the fully operational configuration of the preferred embodiment. In an alternate embodiment, the door 20 may also be fitted with an attached speaker 29 to facilitate audio reception from various types of electronic devices that may also be positioned within the interior of the Towel Shower Caddy 1.

After showering, the user grasps the knob 27 and opens the door 20 by pulling the knob 27 outward. The user removes the towel and any other items from the frame 10 and unplugs any electronic device, which may have been in use, from the speaker 29. Any shampoo bottles or other items on the detachable shelf 70 may also be removed, if desired. The user removes the Towel Shower Caddy 1 from the shower wall by pulling the frame 10 away from the shower wall until the suction created by the suction cup system 80 is broken.

The user removes the hanger system 50 from over the shower pipe, then untwists the left member 51 from the right member 52, and stores them inside the frame 10. The user may or may not detach the components of the suction cup system 80, and place them inside the frame 10. The user closes the hanger cover system 60 to seal the top of the frame 10 so that the holes do not show. The user closes the door 20 by pushing the knob 27 inward towards the frame 10.

If desired, the user may carry the apparatus by the handle assembly 30 with the interior shelf 17, the interior wall 18, the hanger system 50, and the suction cup system 80 stored inside the frame 10. If the wire grid 72 is empty, the user may pull the attachment wires 74 away from the lower indentations 19(*a*) on the frame 10 and reposition the wires 74 so that the wires fit into the upper indentations 19 on the side walls 15 and 16. This ensures that the bottom grid 72 is positioned snug against the bottom wall 13, so that the frame 10 will occupy a smaller volume and be easily carded. The detachment of the above components yields a substantially smaller Towel Shower Caddy 1 that occupies less storage space so that the user may place it on a shelf or in a locker.

The user may also remove the handle assembly 30 and store it inside the frame 10. In this configuration, one frame 10 may be stacked on top of or next to another frame 10 for commercial storage or display purposes. In addition, the user may place the detachable shelf 70 on a surface so that it may be used as an additional storage container.

What has been disclosed and illustrated herein are several embodiments of the inventive concept, along with some of its variations. The terms, descriptions and figures used herein are set forth by way of illustration only and are not meant as limitations. Those skilled in the art will recognize that many variations are possible within the spirit and scope of the inventive conception which all terms are meant in their broadest, reasonable sense unless otherwise indicated. Any headings utilized within the description are for convenience only and have no legal or limiting effect.

What is claimed is:

1. A portable, collapsible apparatus for storing, transporting, and providing immediate and convenient access to (a) toiletries commonly used during bathing or showering, (b) hand-held electronic communication electronic devices, and (c) other personal articles, comprising:
   - a three-dimensional frame comprising a plurality of exterior surfaces, including a topmost surface and a bottommost surface, and having corresponding inner surfaces and further, having an opening on one exterior surface;
   - a door, having perimetral dimensions corresponding to the dimensions of said opening and pivotally attached to the exterior of said frame such that upon closing of the door, the entirety of said opening is covered by said door:
   - a handle assembly and a means for attaching said handle assembly to the topmost exterior surface of said frame;
   - a hanger system, having a left member and a right member wherein both members may be joined to each other and attached to said frame;
   - a means for attaching said hanger system to at least one exterior surface of said frame;
   - a support base system attached to the bottommost exterior surface of said frame;
   - a horizontally-oriented shelf storage system, being removably attached to said frame and spaced apart from the bottommost exterior surface of said frame; and
   - a means for attaching said shelf system to said frame.

2. An apparatus as in claim 1, further comprising a speaker and speaker wiring leads attached to, or integral to, said door.

3. An apparatus as in claim 1, wherein said means for attaching said handle assembly to the topmost exterior surface of said frame comprises a unitary handle assembly-frame apparatus formed by injection molding process.

4. An apparatus as in claim 1, further comprising any one of several electronic devices selected from a group consisting of a cellular phone, a computer, an electronic video tablet, an LED television, a plasma television, a CD player, and an MP-3 player, said device being integral to, or attached to said door.

5. An apparatus as in claim 1, further comprising any one of several electronic devices selected from a group consisting of a cellular phone, a computer, an electronic video tablet, an LED television, a plasma television, a CD player, and an MP-3 player, said device being integral to, or attached to at least one surface of said three dimensional frame.

6. An apparatus as in claim 1, further having a plurality of elastomeric support pads attached to the bottom wall exterior surface and a plurality of elastomeric, suction-creating units attached to the back wall exterior surface.

7. A portable, collapsible apparatus for storing, transporting, and providing immediate and convenient access to (a)

toiletries commonly used during bathing or showering, (b) hand-held electronic communication devices, and (c) personal articles, comprising:

a rectangular, cuboid frame comprising a top wall, a front wall, a bottom wall, a back wall, a left-side wall, and a right-side wall, all said walls having an exterior and an interior surface, and said frame further having an opening in the front wall;

a planar door having perimetral dimensions corresponding to the dimensions of said opening, said door pivotally attached proximate the opening such that upon closing, said door covers the entirety of the opening;

a handle assembly, haying a body, a left end, and a right end, said ends both being encased in the top surface of said frame and the body of said handle assembly being coliapsibly storable in a housing cavity within said top wall;

a left and a right frame hole, respectively, fabricated through the top surface of said frame;

a plurality of symmetrical indentations placed onto each of the left-side and right-side side walls;

a hanger system, having a left member and a right member wherein both members may be removably attached to each other;

a means for attaching said hanger system to the exterior surface of said top wall;

a left and a right hanger cover affixed to the top wall exterior surface, said covers providing coverage over said left and right frame holes on the top wall;

a plurality of elastomeric support pads attached to the bottom wall exterior surface;

a plurality of suction-generating elastomeric fittings attached to the back wall exterior surface;

a horizontally-oriented exterior shelf system, detachably fixed, by means of vertically-oriented attachment wire members, to any two of said plurality of indentations on each of the exterior surfaces of the left-side and right-side walls; and at least one interior shelf and at least one vertical divider interiorly attached to the inner surfaces of the back wall, the left-side wall, and the right-side wall, wherein said exterior shelf system may be attached either abutting or spaced-apart from the exterior surface of said bottom wall; said left member and right member hanger system comprises a left tubular assembly and a right tubular assembly respectively, each tubular assembly having one end comprising a stopper end insertable into either of said left and right frame holes, and further, said left handle assembly having a receiving end and said right handle assembly having an engaging end whereby said receiving end and said engaging end may be connected to one another, forming a unitary hanger.

8. An apparatus as in claim 7 where said horizontally-oriented exterior shelf system comprises a wire grid having, on each side, vertically extending attachment wires for insertion into any combination of the plurality of indentations of said left-side and right-side walls.

9. An apparatus as in claim 7, further comprising a speaker and speaker wiring leads attached to, or integral to, said door.

10. An apparatus as in claim 7, where said hand-held electronic communication devices may be any device selected from a group consisting of a cellular phone, a computer, an electronic video tablet, an LED television, a plasma television, a CD player, and an MP-3 player, said device being integral to or attached to said door.

11. An apparatus as in claim 7, where said hand-held electronic communication devices may be any device selected from a group consisting of a cellular phone, a computer, an electronic video tablet, an LED television, a plasma television, a CD player, and an MP-3 player, said device being integral to, or attached to said frame.

12. An apparatus as in claim 7, wherein said shelf system further comprises a wire grid consisting of orthogonally-oriented wires, said wires further coated with a water-proof material.

13. A portable, collapsible apparatus for storing, transporting, and providing immediate and convenient access to (a) toiletries commonly used during bathing or showering, (b) hand-held electronic communication devices, and (c) personal articles, comprising:

a rectangular, cuboid frame comprising a top wall, a front wall, a bottom wall, a back wall, a left-side wall, and a right-side wall, all said walls having an exterior and an interior surface, said frame further having an opening in the front wall;

a door having perimetral dimensions corresponding to the dimensions of said opening, said door pivotally attached proximate the opening such that upon closing, said door covers the entirety of the opening;

a tensioned, dual-pronged retainer clip permanently affixed to an interior surface of said frame, said retainer clip comprising inner dimensions compatible with the exterior dimensions of a typical cellular telephone;

a handle assembly, having a body, a left end, and a right end, said ends both being insertably attached by means of slots in the top surface of said frame and the handle assembly assembly being collabsibly storable in a housing cavity within said top wall;

left and right frame holes through the top surface of said frame;

a hanger system, having a left member and a right member wherein both members may be removably attached to each other;

a means for attaching said hanger system to at least one exterior surface of said frame;

a left and a right hanger cover affixed to the top wall exterior surface, said covers providing coverage over left and right holes on the left and right extremities of said top wall;

a plurality of elastomeric support pads attached to the bottom wall exterior surface;

a plurality of suction-generating elastomeric fittings attached to the back wall exterior surface;

a detachable shelf system, removably affixed to the exterior surfaces of the right-side and left-side walls; and at least one interior shelf and at least one vertical divider interiorly attached to the inner surfaces of the back wall, the left-side wall, and the right-side wall, wherein said left-side and right-side walls comprise a plurality of symmetrical exterior indentations such that said detachable shelf system may be attached in a spaced-apart manner from said bottom surface; said two-section hanger comprises a left tubular assembly and a right tubular assembly, each tubular assembly having one end comprising a stopper end insertable into the top wall, and further, said left handle assembly having a receiving end and said right handle assembly having an engaging end whereby said receiving end and said engaging end may be connected to one another, forming a unitary hanger; and said detachable shelf system comprises a wire grid having, on each side, vertically extending attachment wires for insertion into the indentations of said left-side and right-side walls.

14. An apparatus as in claim 13 where said detachable shelf system, removably affixed to the exterior surfaces of the right-side and left-side walls comprises a wire grid having, on each side, vertically extending attachment wires for insertion into the indentations of said left-side and right-side walls.

15. An apparatus as in claim 13, further comprising a speaker and speaker wiring leads attached to, or integral to, said door.

16. An apparatus as in claim 13, further comprising any one of several electronic devices selected from a group consisting of a cellular phone, a computer, an electronic video tablet, an LED television, a plasma television, a CD player, and an MP-3 player, said device being integral to, or attached to said door.

17. An apparatus as in claim 13, further comprising any one of several electronic devices selected from a group consisting of a cellular phone, a computer, an electronic video tablet, an LED television, a plasma television, a CD player, and an MP-3 player, said device being integral to, or attached to said frame.

18. An apparatus as in either claim 1 or 13, further comprising a speaker embedded in, or attached to, said door, a de volt battery, electrical wiring, connectors, and jacks utilized for operation of any electronic communications device installed in said apparatus.

19. An apparatus as in either claim 7 or 13, further comprising a half-cylindrical form constructed into the bottom wall and the back wall, said form having inner arcuate dimensions enabling the fit of the form over standard residential shower pipes.

20. An apparatus as in any one of claim 1, 7, or 13, further comprising a wireless speaker attached to, or integral to said door.

21. An apparatus as in any one of claim 7 or 13, further comprising at least one interior shelf and at least one vertical divider, each of which is removably attached to the inner surfaces of the back wall, the left-side wall, and the right-side wall.

* * * * *